US010852083B2

(12) United States Patent
Underwood et al.

(10) Patent No.: US 10,852,083 B2
(45) Date of Patent: Dec. 1, 2020

(54) BUFFER EXTENSION

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 16/706,648

(22) Filed: Dec. 6, 2019

(65) Prior Publication Data

US 2020/0182569 A1 Jun. 11, 2020

Related U.S. Application Data

(60) Provisional application No. 62/776,591, filed on Dec. 7, 2018.

(51) Int. Cl.
*F41A 3/84* (2006.01)

(52) U.S. Cl.
CPC ..... *F41A 3/84* (2013.01)

(58) Field of Classification Search
CPC ..... F41A 3/78; F41A 3/80; F41A 3/82; F41A 3/84; F41A 3/90; F41A 3/92; F41A 3/94; F41C 23/06
See application file for complete search history.

(56) References Cited

U.S. PATENT DOCUMENTS

| | | | | |
|---|---|---|---|---|
| 3,366,011 | A * | 1/1968 | Sturtevant | F41A 3/70 89/198 |
| 8,468,729 | B1 * | 6/2013 | Sylvester | F41A 3/84 42/1.01 |
| 9,341,437 | B1 * | 5/2016 | Huang | F41A 3/84 |
| 9,921,013 | B1 * | 3/2018 | Oglesby | F41A 3/80 |
| 10,054,378 | B2 * | 8/2018 | Pawlowski | F41A 3/84 |
| 10,557,674 | B1 * | 2/2020 | Mantas | F41A 3/84 |
| 2013/0192114 | A1 * | 8/2013 | Christenson | F41A 3/12 42/16 |
| 2014/0041518 | A1 * | 2/2014 | Neitzling | F41A 3/78 89/191.01 |
| 2014/0059909 | A1 * | 3/2014 | Caudle | F41A 3/84 42/1.06 |
| 2017/0160028 | A1 * | 6/2017 | Martinez, Jr. | F41A 3/66 |
| 2017/0205164 | A1 * | 7/2017 | Cassels | F41A 3/84 |
| 2018/0266782 | A1 * | 9/2018 | Bender | F41A 3/56 |

OTHER PUBLICATIONS

M16 Clinic AR-15/M16/308 AR Buffer Pad . <http://web.archive.org/web/20170417073737/https://www.brownells.com/rifle-parts/receiver-parts/recoil-parts/recoil-buffers/ar-15-m16-308-ar-buffer-pad-prod19699.aspx>. Apr. 17, 2017. (Year: 2017).*

* cited by examiner

*Primary Examiner* — Gabriel J. Klein

(57) ABSTRACT

A buffer extension assembly may include a body having at least one face and a cylindrical surface. The body may be disposed between and contact at least one of a buffer and a bolt carrier group such that the body increases both the effective mass and the effective length of the buffer. The body includes at least one hole extending along a length of the body.

18 Claims, 5 Drawing Sheets

BUFFER EXTENSION

CROSS REFERENCE TO RELATED APPLICATION

This application is related to and claims priority benefit from U.S. Provisional Application No. 62/776,591 ("the '591 application"), filed on Dec. 7, 2018 and entitled "BUFFER EXTENSION." The '591 application is hereby incorporated in its entirety by this reference.

FIELD OF THE INVENTION

The field of the invention relates to firearms, particularly methods and devices for buffers and extending buffers of a firearm.

BACKGROUND

Many modern firearms include a buffer that absorbs energy after firing a round. In some cases, the buffer interacts with a bolt or bolt carrier group. The buffer may be fixed or may be capable of moving. In some cases, the buffer is located within a tube (e.g., a buffer tube) adjacent to a spring (e.g., a buffer spring).

In some cases, particular firearm designs may be adapted to function with various calibers. For example, the popularity of AR-15 variant (civilian) or M16/M4 (military) firearms has inspired numerous variations for different calibers. Most typical AR-15 firearms are chambered for 5.56×45 mm NATO and/or .223 Remington. Many receivers, magazines, and/or firearms may be modified to operate with 300 BLK (7.62×35 mm). However, conventional designs intended to use other calibers often require other changes to the firearm, such as a different receiver, modification to the receiver, a different magazine, a different buffer spring, and/or a different buffer. Accordingly, it may be desirable to retrofit a conventional firearm with a buffer extension assembly such that a conventional buffer and a conventional buffer spring can be used with alternative caliber ammunition.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a buffer extension assembly comprises: a body comprising at least one face and a cylindrical surface, wherein the body is disposed between and contacts at least one of a buffer and a bolt carrier group such that the body increases both the effective mass and the effective length of the buffer.

DETAILED DESCRIPTION

Figure 1A:
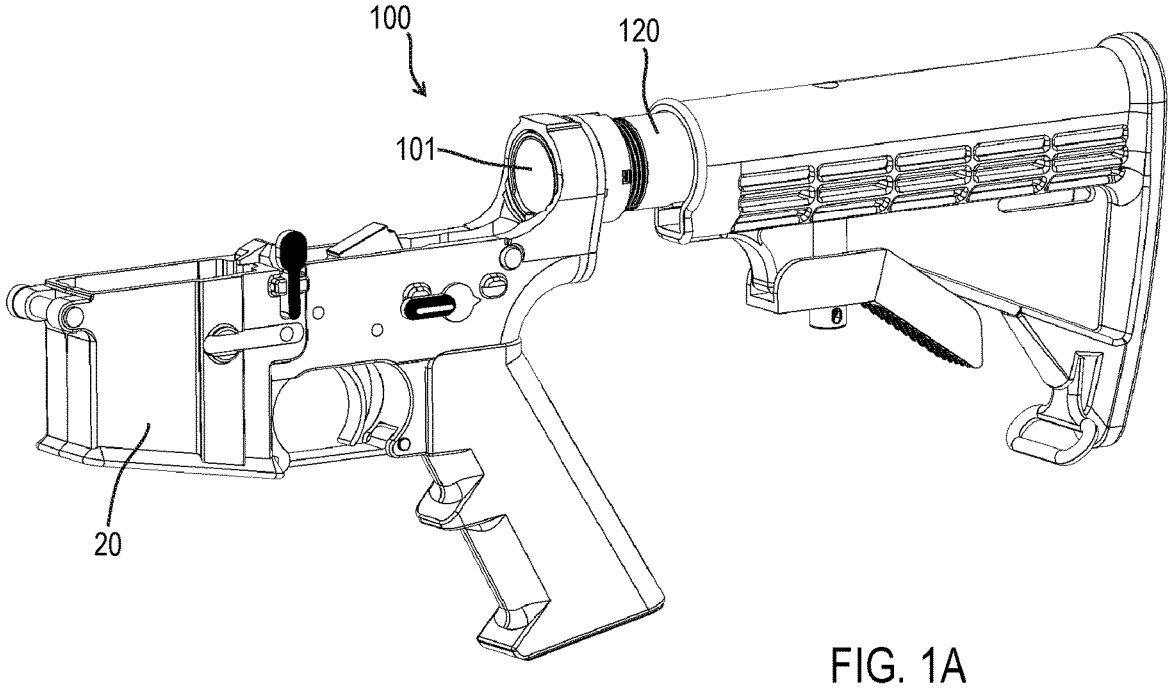
FIG. 1A is a perspective view of a firearm including a buffer extension assembly, according to certain embodiments of the present invention.
Figure 1B:
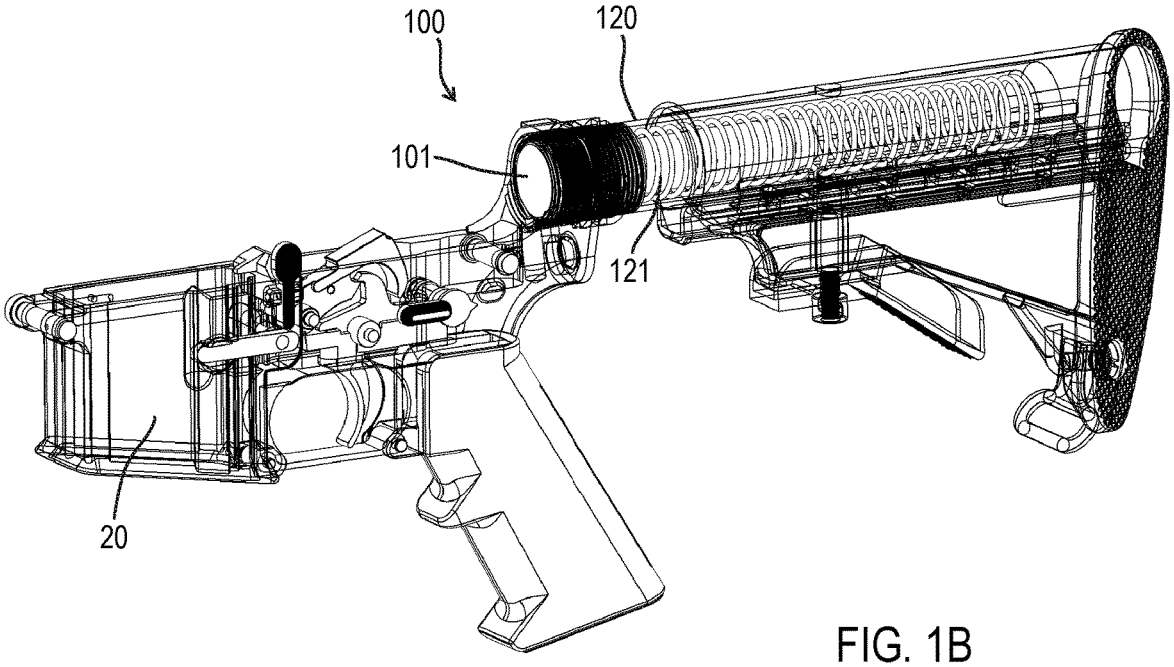
FIG. 1B is a partially transparent view of the firearm of FIG. 1A.
Figure 2A:
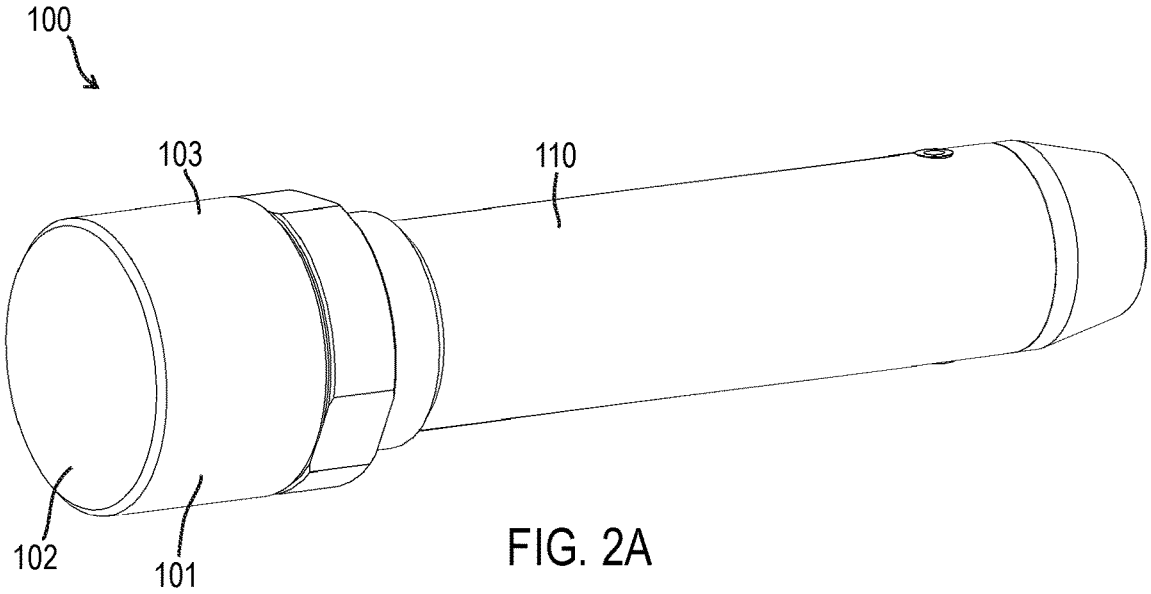
FIG. 2A is a perspective view of the buffer extension assembly of the firearm of FIG. 1A.
Figure 2B:
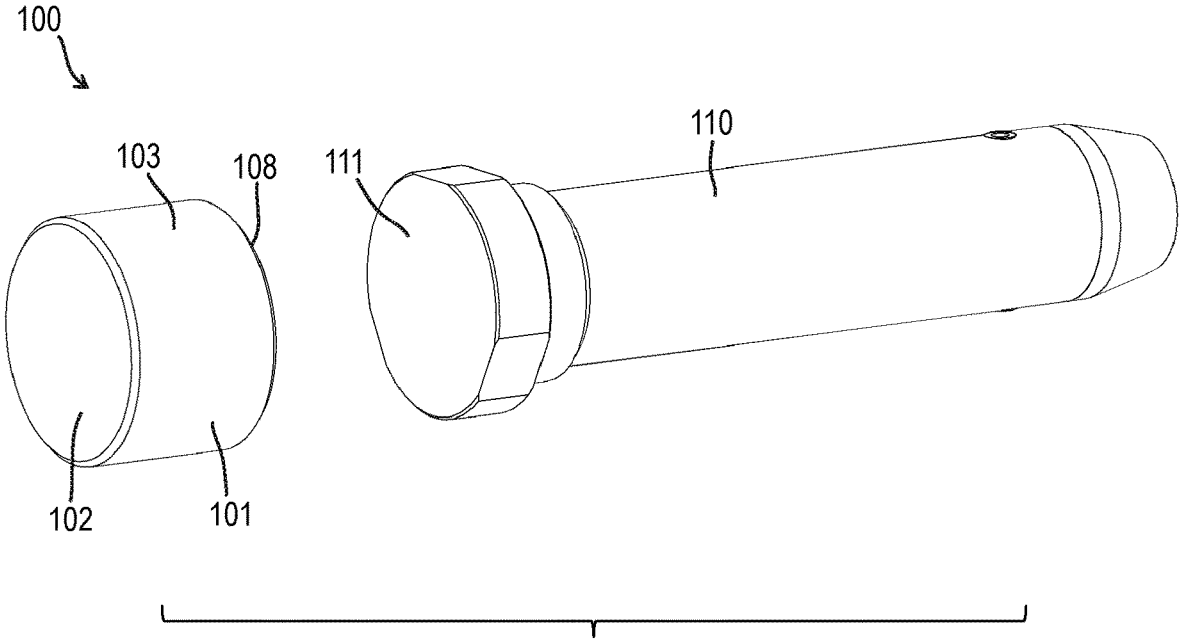
FIG. 2B is an exploded perspective view of the buffer extension assembly of FIG. 2A.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1A-4C illustrate components of various semi-automatic or automatic rifles, the features, concepts, and functions described herein are also applicable (with potential necessary alterations for particular applications) to handguns, rifles, carbines, shotguns, or any other type of firearm. Furthermore, the embodiments may be compatible with various calibers including rifle calibers such as, for example, 5.56×45 mm NATO, .223 Remington, 7.62×51 mm NATO, .308 Winchester, 7.62×39 mm, 5.45×39 mm; handgun calibers such as, for example, 9×19 mm, .45 ACP, .40 S&W, .380 ACP; and shotgun calibers such as, for example, 12 gauge, 20 gauge, 28 gauge, .410 gauge, 10 gauge, 16 gauge.

According to certain embodiments of the present invention, as shown in FIGS. 1A-4C, a buffer extension assembly 100 may interface with the buffer tube 120 of a firearm. The firearm may include a receiver 20. The buffer extension assembly 100 may be located within the buffer tube 120 adjacent to the buffer 110. The buffer extension assembly 100 is shown at a forward end of the buffer tube 120 in FIGS. 1A and 1B. In some cases, the buffer 110 is located between the spring 121 and the buffer extension assembly 100 such that the buffer extension assembly 100 is disposed adjacent to the buffer face 111. In other words, when the bolt or bolt carrier group is moved to a rear position, the buffer extension assembly 100 is disposed between (and may contact one or both of) the buffer 110 and the bolt or bolt carrier group. The buffer extension assembly 100 may include a body 101. The body 101 may push the buffer 110 toward the aft end of the buffer tube 120 (away from the forward end)—effectively increasing the overall length of the buffer 110, which will increase compression in the buffer spring 121. The body 101 may also effectively increase the mass of the buffer 110. Changing one or both of these variables allows a user to adapt or tune a buffer to function better with varying calibers or even for different variables for a single caliber (e.g., bullet weight, bullet size, bullet type, powder type, powder quantity, etc.). In some embodiments, the addition of the buffer extension assembly 100 includes sufficient additional mass and/or length such that a standard 5.56×45 mm NATO (and/or .223 Remington) buffer (e.g., a carbine buffer) can be used with other calibers. As one example, a user may remove an upper assembly chambered for 5.56×45 mm NATO (which functions with buffer 110) and attach an upper chambered for 9×19 mm to receiver 20 along with inserting buffer extension assembly 100.

As shown in FIGS. 2A-3B, the body 101 may include at least one face 102 and a cylindrical surface 103. In some embodiments, the at least one face 102 is a front face 102 and the body 101 may also include a rear face 108. In some embodiments, the length of the body 101 (distance between front face 102 and rear face 108) may be approximately 17 mm (0.670 inches) to approximately 20 mm (0.790 inches).

Figure 3A:
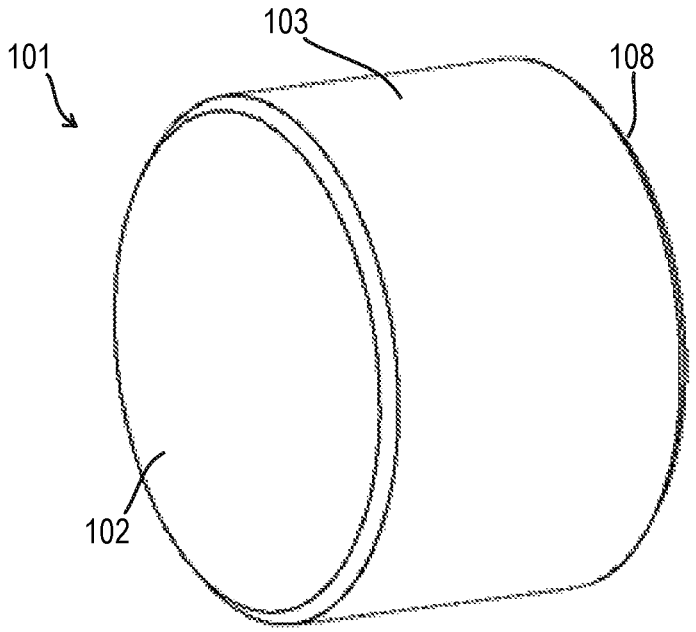
FIG. 3A is a perspective view of a body of the buffer extension assembly of FIG. 2A.
Figure 3B:
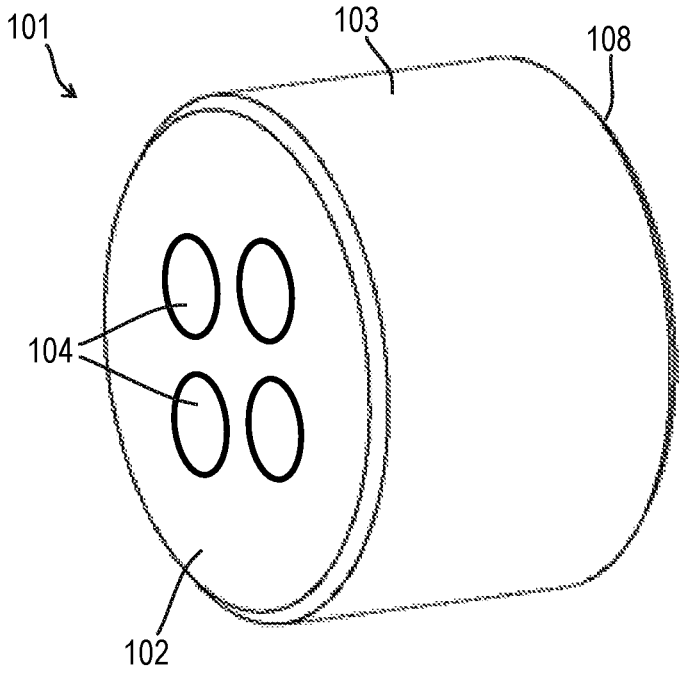
FIG. 3B is a perspective view of a body of the buffer extension assembly of FIG. 2A.
Figure 4A:
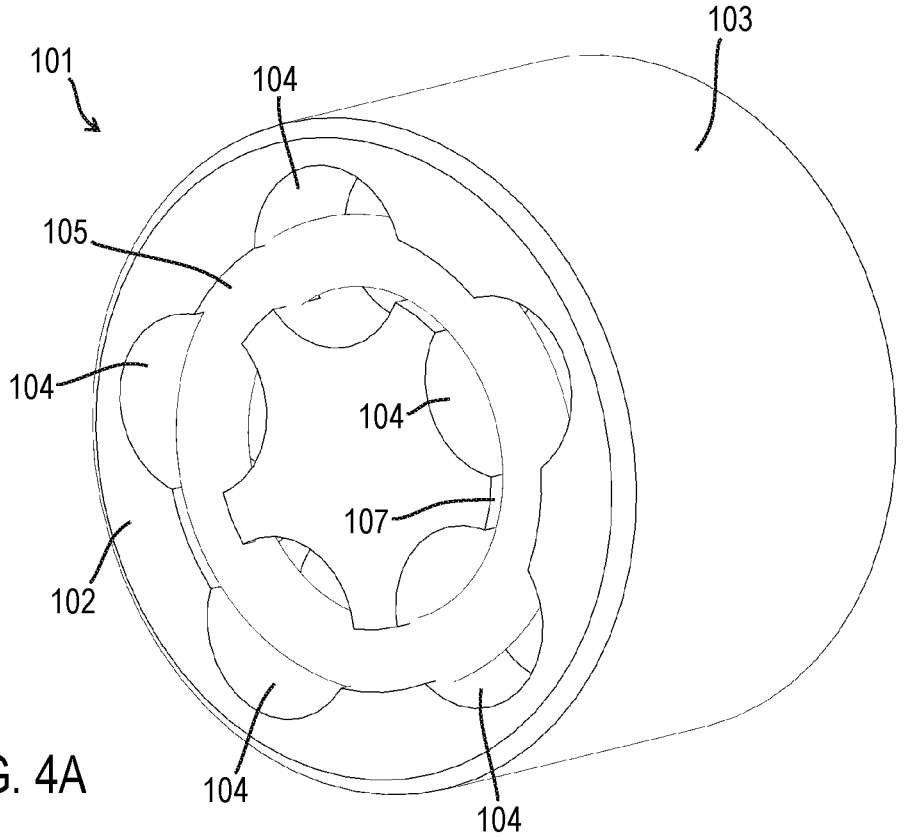
FIG. 4A is a perspective view of a body of the buffer extension assembly of FIG. 2A.
Figure 4B:
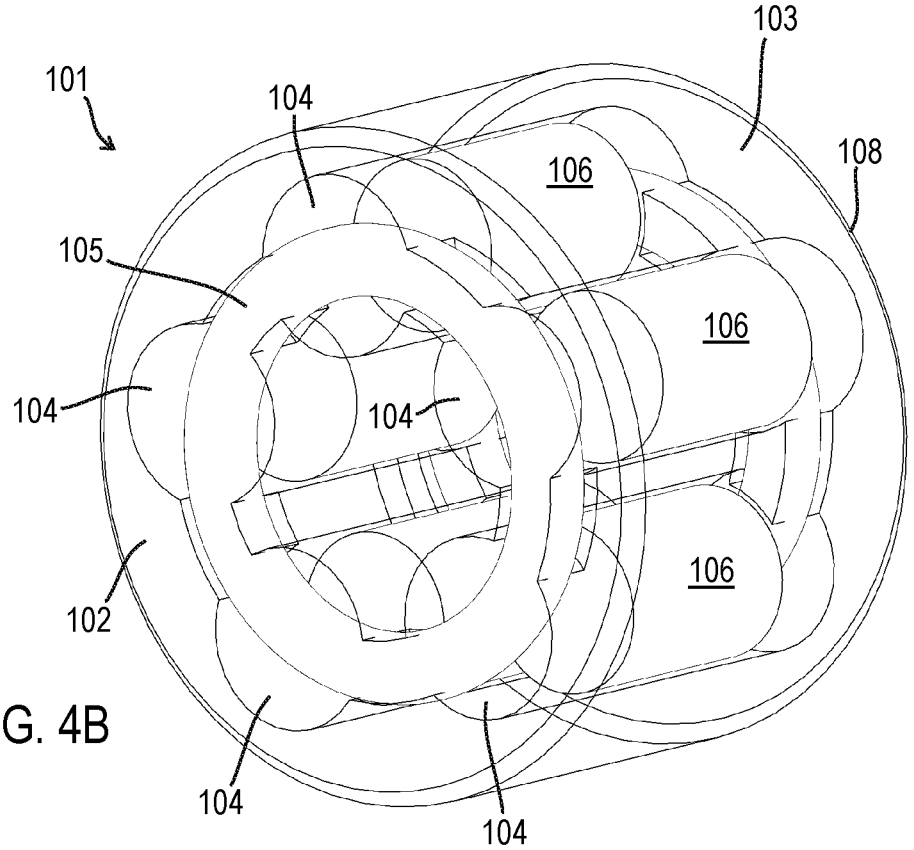
FIG. 4B is a partially transparent perspective view of the body of FIG. 4A.
Figure 4C:
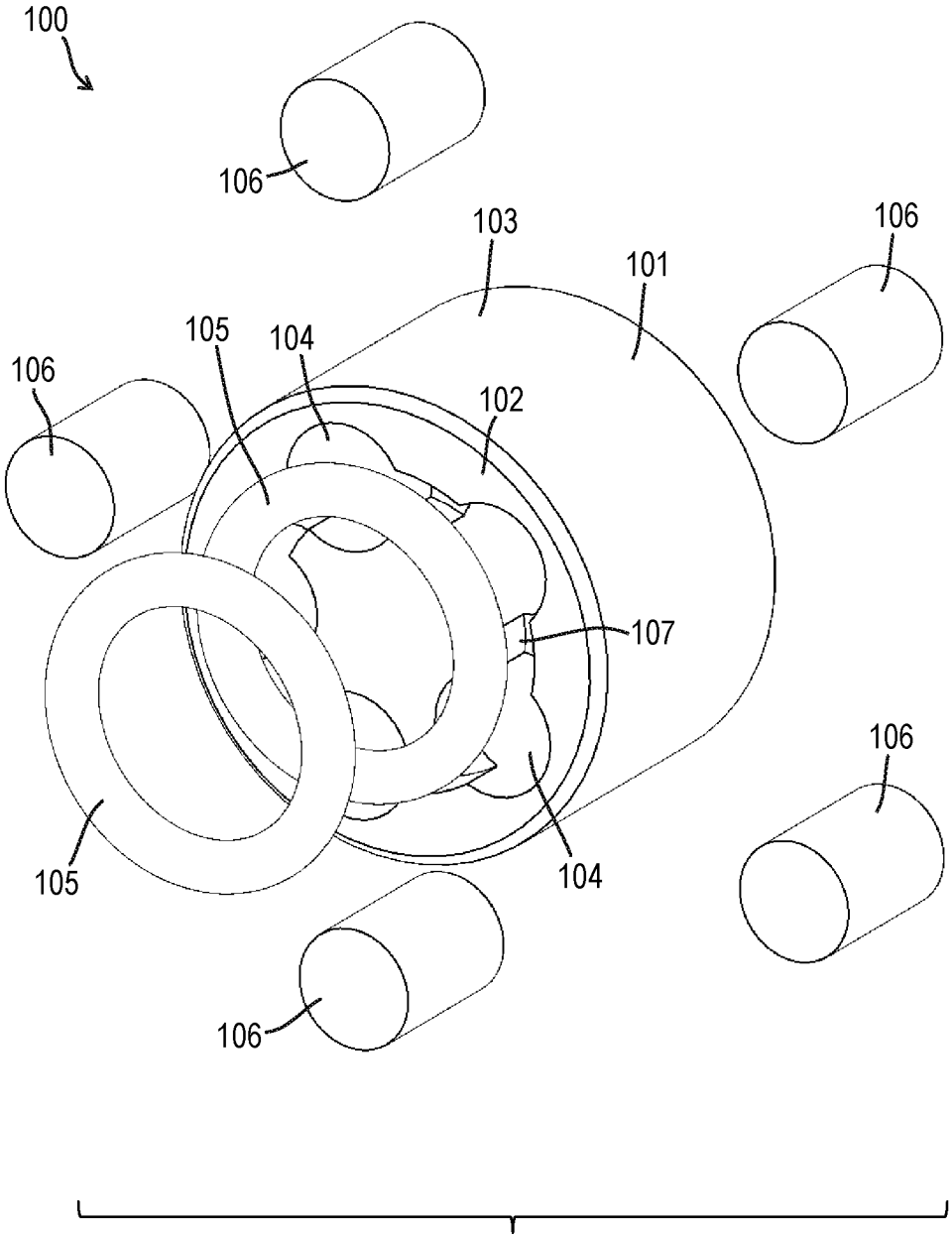
FIG. 4C is an exploded perspective view of the body of FIG. 4A.

FIGS. 3A and 3B show the body 101 of the buffer extension assembly 100. In some embodiments, the body 101 is a simple solid cylinder, as shown in FIG. 3A. In other embodiments, the body 101 may include at least one hole 104, as shown in FIG. 3B. The at least one hole 104 may function to reduce the weight of the body 101 and/or may allow one or more weights to be inserted into the body 101. The body 101 may include any number of holes 104 including zero, one, or more. FIG. 3B shows one example with four holes 104 and FIGS. 4A-4C show an example with five holes 104. Configurations that incorporate the at least one hole 104 allow for modularity such that the mass of the body can be adjusted between a minimum where each and every of the at least one hole 104 is empty to a maximum weight where weight(s) that fill the length and cross section of each of the at least one hole 104 are inserted into the body 101. There may be intermediate masses where some but not all of the holes 104 include weights and the weights may extend less than a full length and/or less than a full cross-section of the holes 104. The body 101 may be steel, tungsten, tungsten carbide, or any other appropriate material.

In some embodiments, as shown in FIGS. 4A-4C, the body 101 may include at least one weight 106 for each hole 104 where the weights 106 include approximately the same cross-section size/shape as the hole 104. In some cases, the weights 106 do not extend the full length of the holes 104. The weights 106 may be steel, tungsten, tungsten carbide, or any other appropriate material. The body 101 may also include an O-ring 105 that may be inserted into a groove 107 on one or both of the front face 102 and the rear face 108 of the body 101. In some embodiments, the groove 107 has a cross-section that is smaller than the O-ring 105 such that the O-ring 105 may have an interference fit and remain attached within the groove 107. In addition, the O-ring 105 may compress and thus dampen/attenuate impact of the weight(s) 106 and/or prevent breakage of the weight(s) 106.

As described above, the weights 106 may be shorter than the length of the holes 104 such that, in some cases, movement of the body 101 results in a "dead blow" effect. The dead blow effect reduces recoil or rebound of the buffer extension assembly 100 and minimizes the potential damage to the bolt or bolt carrier group due to the impact from the body 101.

The components of any of the firearms described herein may be formed of materials including, but not limited to, thermoplastic, carbon composite, plastic, nylon, steel, aluminum, stainless steel, high strength aluminum alloy, other plastic or polymer materials, other metallic materials, other composite materials, or other similar materials. Moreover, the components of the firearms may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A buffer extension for a firearm that includes a buffer, a buffer spring, and a bolt carrier group, the buffer extension comprising:

a body comprising a front face, a rear face, a length extending from the front face to the rear face, at least one hole extending along the length, at least one weight disposed within the at least one hole, and an outer surface, wherein:

an entirety of the buffer extension is disposed between a forwardmost face of the buffer and a rearmost surface of the bolt carrier group;

the rear face of the buffer extension contacts the forwardmost face of the buffer when the buffer is pushed to a forwardmost position by the buffer spring and during rearward movement of the buffer;

the front face of the buffer extension contacts the rearmost surface of the bolt carrier group; and the buffer extension increases both the effective mass and the effective length of the buffer.

2. The buffer extension of claim 1, wherein the at least one hole comprises at least four holes.

3. The buffer extension of claim 1, wherein the front face comprises a groove that intersects at least a portion of the at least one hole.

4. The buffer extension of claim 3, further comprising an O-ring disposed within the groove.

5. The buffer extension of claim 4, wherein, when the O-ring is disposed within the groove, the O-ring is approximately flush with the front face.

6. The buffer extension of claim 1, wherein a material of the at least one weight comprises at least one selected from the group of steel, tungsten, and tungsten carbide.

7. The buffer extension of claim 1, wherein the at least one weight has a length that is less than a length of the at least one hole.

8. The buffer extension claim 1, wherein the at least one weight moves within the at least one hole during movement of the buffer to create a dead blow effect.

9. The buffer extension of claim 1, wherein a length of the body is 17 mm to 20 mm.

10. A buffer extension for a firearm that includes a buffer, a buffer spring, and a bolt carrier group, the buffer extension comprising:

a cylindrical body comprising a front face, a rear face, a length extending from the front face to the rear face, a plurality of holes extending along the length, and an outer surface, wherein:

an entirety of the buffer extension is disposed between a forwardmost face of the buffer and a rearmost surface of the bolt carrier group;

the rear face of the buffer extension contacts the forwardmost face of the buffer when the buffer is pushed to a forwardmost position by the buffer spring and during rearward movement of the buffer; and the front face of the buffer extension contacts the rearmost surface of the bolt carrier group.

11. The buffer extension of claim 10, wherein the front face comprises a groove that intersects at least a portion of the plurality of holes.

12. The buffer extension of claim 11, further comprising an O-ring disposed within the groove.

13. The buffer extension of claim 12, wherein, when the O-ring is disposed within the groove, the O-ring is approximately flush with the front face.

14. The buffer extension of claim 10, further comprising at least one weight disposed within the plurality of holes.

15. The buffer extension of claim 14, wherein a material of the at least one weight comprises at least one selected from the group of steel, tungsten, and tungsten carbide.

16. The buffer extension of claim 14, wherein the at least one weight has a length that is less than a length of the plurality of holes.

17. The buffer extension of claim 14, wherein the at least one weight moves within the plurality of holes during movement of the buffer to create a dead blow effect.

18. A buffer extension comprising:

a body comprising at least one face, an outer surface, and at least one hole extending along a length of the body, wherein the face comprises a groove that intersects at least a portion of the at least one hole; and an O-ring disposed within the groove, wherein the body is disposed between and contacts at least one of a buffer and a bolt carrier group such that the body increases both the effective mass and the effective length of the buffer.

* * * * *